US005884696A

United States Patent [19]

Loup

[11] Patent Number: 5,884,696

[45] Date of Patent: Mar. 23, 1999

[54] HEAT EXCHANGER OF REDUCED SIZE FOR HEAT TRANSFER BETWEEN THREE FLUIDS

[75] Inventor: Didier Loup, Maurepas, France

[73] Assignee: Valeo Climatisation, La Verriere, France

[21] Appl. No.: 577,054

[22] Filed: Dec. 22, 1995

[30] Foreign Application Priority Data

Dec. 26, 1994 [FR] France ..... 94 15652

[51] Int. Cl.[6] ..... F28F 1/12; F28F 3/14; F28D 1/02; F28D 9/02

[52] U.S. Cl. ..... 165/140; 165/167; 165/176; 165/43; 165/42

[58] Field of Search ..... 165/42, 43, 140, 165/176, 167

[56] References Cited

U.S. PATENT DOCUMENTS

| | | | |
|---|---|---|---|
| 2,617,634 | 11/1952 | Jendrassik . | |
| 2,884,768 | 5/1959 | Gould | 165/140 |
| 3,537,513 | 11/1970 | Austin et al. | 165/140 |
| 4,002,201 | 1/1977 | Donaldson | 165/140 |
| 4,217,953 | 8/1980 | Sonoda et al. | 165/176 |
| 4,249,597 | 2/1981 | Carey | 165/166 |
| 4,274,481 | 6/1981 | Ireland et al. | 165/140 |
| 4,327,802 | 5/1982 | Beldam | 165/153 |
| 4,976,309 | 12/1990 | Averin | 165/42 |
| 5,180,004 | 1/1993 | Nguyen | 165/140 |
| 5,186,244 | 2/1993 | Joshi . | |

FOREIGN PATENT DOCUMENTS

| | | | |
|---|---|---|---|
| 0 431 917 A1 | 6/1991 | European Pat. Off. . | |
| 0 431 917 B1 | 5/1994 | European Pat. Off. . | |
| 0018514 | 1/1982 | Japan | 165/43 |
| 0293086 | 12/1987 | Japan | 165/140 |
| 2052722 | 1/1981 | United Kingdom . | |

OTHER PUBLICATIONS

French Search Report dated Sep. 7, 1995.

*Primary Examiner*—John K. Ford
*Attorney, Agent, or Firm*—Morgan & Finnegan, L.L.P.

[57] ABSTRACT

The engine cooling radiator and the evaporator of the air conditioning system for a vehicle are combined in a single triple heat exchanger, in which the refrigerant fluid and the engine coolant fluid flow respectively in two sets of flat pockets which are stacked alternately with gaps in which the air to be treated flows. A pocket of one set is directly juxtaposed to a pocket of the other set, to form a pair of pockets, between each gap and the next, to give direct heat transfer between the refrigerant and engine coolant fluids.

4 Claims, 2 Drawing Sheets

HEAT EXCHANGER OF REDUCED SIZE FOR HEAT TRANSFER BETWEEN THREE FLUIDS

FIELD OF THE INVENTION

This invention relates to triple heat exchangers, of the kind adapted for effecting heat transfer between a gaseous first fluid and second and third fluids flowing in two separate fluid circuits, the heat exchanger being so constructed as to have a series of generally flat gaps, i.e. internal spaces, each of which has two parallel longitudinal sides spaced apart by an amount much smaller than the length of the longitudinal sides, the gaps being in stacked relationship, i.e. the longitudinal sides of the gaps are all generally parallel to each other, to define a stacking direction at right angles to their longitudinal sides, with the gaps being defined in a stack alternately with a first set of flat pockets and a second set of flat pockets, in which the said second and third fluids flow respectively, with one pocket of each set being disposed between two consecutive gaps, and each pocket being separated from at least one adjacent gap by a thermally conductive wall, over which a stream of the said first fluid, passed through the gap, flows.

BACKGROUND OF THE INVENTION

A heat exchanger of the above kind is described in EP-A-0 431 917. This known heat exchanger serves as a radiator for cooling the engine of a motor vehicle, and also as the condenser of an air conditioning system for the cabin of the vehicle. The first fluid in that case is atmospheric air, while the second fluid is engine coolant and the third fluid is the refrigerant of the air conditioning system. The two pockets disposed between two consecutive gaps are juxtaposed to each other, and each of these pockets extends over a fraction of the surface area of the stack. They are spaced away from each other by a certain amount, and each pocket lies adjacent to two consecutive gaps. The total size of that heat exchanger, in the direction in which the pockets are juxtaposed (i.e. the stacking direction), corresponds to the sum of the dimensions in that direction of an equivalent separate radiator and separate condenser, augmented by an additional amount corresponding to the sum of the distances between the pairs of juxtaposed pockets.

In air conditioning systems for vehicle cabins, it is current practice to arrange, in series in the flow path of air to be treated, an evaporator which is part of the refrigerant fluid circuit and which is arranged to receive this air, together with a radiator for heating the air. Since very little space is generally available for air conditioning systems, there is nowadays a tendency, in order to save space, to replace these two heat exchangers with a single combined heat exchanger which performs both functions. However, such a space saving cannot be achieved with the arrangement disclosed by the prior document cited above, for the reasons already explained.

DISCUSSION OF THE INVENTION

An object of the present invention is to overcome the disadvantage mentioned above, and to provide a triple heat exchanger occupying less space than the combination of two separate heat exchangers which it replaces.

Another object is to obtain, besides the direct heat transfer between the first fluid and each of the second and third fluids, direct heat transfer between the second and third fluids themselves. In the type of heat exchanger mentioned above which serves both as a heating radiator and as an evaporator, the direct heat transfer between the heat-bearing fluid in the heating radiator and the refrigerant fluid in the evaporator tends to favour the transfer of heat towards the latter fluid, and consequently leads to its complete evaporation.

According to the invention in a first aspect, a triple heat exchanger for the exchange of heat between a gaseous first fluid and second and third fluids flowing in separate circuits, having a series of flat gaps stacked in a stacking direction alternately with a first set of flat pockets and a second set of flat pockets, in which flow the second and third fluids respectively, with a pocket of each set being disposed between two consecutive gaps, and each pocket being separated from at least one adjacent gap by a thermally conductive wall arranged for a stream of the first fluid, flowing in the said gap, to flow over it, is characterised in that the two pockets disposed between two consecutive gaps are superimposed on each other in the stacking direction, and each of them extends over, and is in direct mutual thermal contact with, substantially the whole surface area of the stack.

The size of the heat exchanger, in the direction of the lateral width of the pockets, is thus reduced with respect to that of a simple two-fluid heat exchanger. This reduction is obtained at the cost of an increase in size in the stacking direction, but this increase is limited to the sum of the transverse widths (or thicknesses) of the pockets of a said set of pockets, i.e. their width in the stacking direction. In volumetric terms there is an overall reduction in size. In addition, direct heat transfer between the second and third fluids is ensured by the surface contact between the pockets of the two sets.

Optional features of the invention, complementary and/or alternative to each other, are as follows.

The thickness, or transverse width in the stacking direction, of each gap is defined by a thin, corrugated thermally conductive plate, the crests of which are in alternate contact with the two walls bounding the said gap and defining the longitudinal sides of the latter, and which serves as a spacer between the two corresponding pockets and plays a part in the transfer of heat between the three fluids.

Each pocket is defined by two press formed sheet metal plates in the form of dished flat plates, the concavities of which face towards each other and which are joined together sealingly at their periphery.

The two sheet metal plates are also joined together sealingly in a median zone halfway along their lateral width, and over a substantial fraction of their length, extending from a first end of the latter so as to define, for the fluid flowing in the pocket, a U-shaped flow path, the two branches of which lie on either side of the said median, or junction, zone.

The depth of the recessed or dished portion of each said plate in the stacking direction is increased in a region adjacent to the said first end, on either side of the said median zone, so as to define a fluid inlet chamber for the pocket and a fluid outlet chamber of the pocket, the pairs of said chambers (i.e. the pairs of each of which consists of an inlet chamber and an outlet chamber) of a common set of pockets being aligned in the said direction at one longitudinal end of the stack, with the base portion of a said recessed portion in the said region being in sealing contact with the base portion of a recessed portion defined by the next pocket of the same set, around a hole formed in each of the said two base portions, being sealed with respect to the outside of the pockets so as to enable the fluid to pass from one of the inlet and outlet chambers, defined by the two recessed portions, to the other.

The inlet chambers and outlet chambers of one set of pockets, on the one hand, and the inlet chambers and outlet chambers of the other set of pockets on the other hand, are aligned with each other at the two opposite ends of the stack.

The pockets of at least one set are interrupted at a distance from the inlet and outlet chambers of the other set of pockets, at the end of the stack at which these chambers are located, so as to define at least one lateral zone of the stack in which the first fluid exchanges heat with only one of the second and third fluids. In an air conditioning system, the air that has passed through such a lateral zone may be delivered into a part of the cabin in which the air is desired to be either warmer or cooler than in the other parts of the cabin. If necessary, a warm air zone and a cool air zone may be provided on either side of the stack.

The inlet chambers, on the one hand, and the outlet chambers on the other hand, of a common set of pockets are aligned with each other so as to define an inlet duct and an outlet duct respectively, the U-shaped flow paths defined by the said pockets being disposed in parallel between the inlet and outlet ducts.

According to the invention in a second aspect, in the use of a heat exchanger according to the said first aspect of the invention, the said first, second and third fluids consist, respectively, or air for delivery into the cabin of a vehicle, a refrigerant fluid such as to pass from the liquid to the gaseous state in the heat exchanger by absorption of heat, and a hot fluid which yields heat to the two other fluids.

The various features and advantages of the invention will appear more clearly from the detailed description of a preferred embodiment of the invention which follows, and which is given by way of example and with reference to the accompanying drawings.

DESCRIPTION OF A PREFERRED EMBODIMENT OF THE INVENTION

Figure 1:
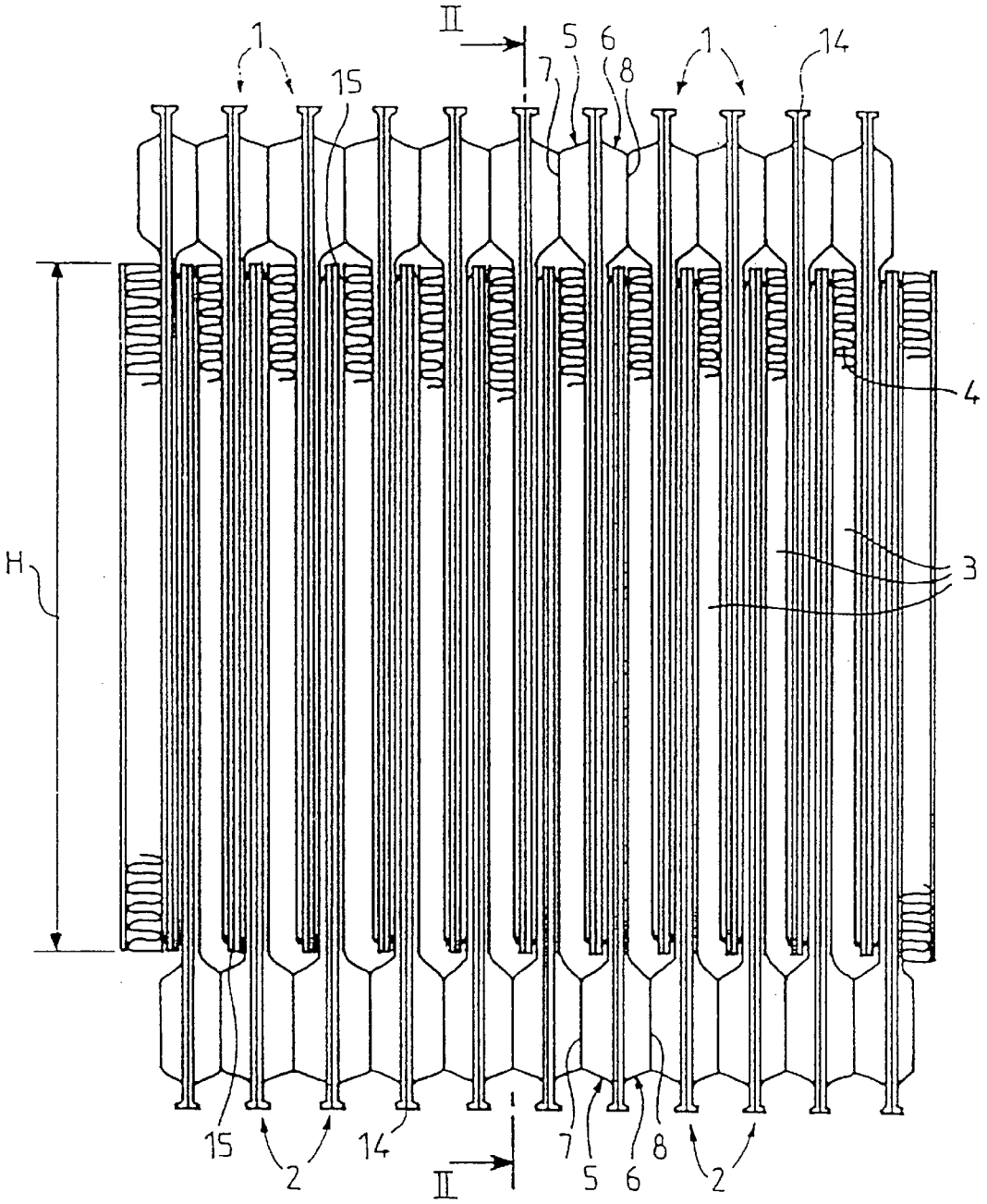
FIG. 1 is a side view of the stack of gaps and pockets in a heat exchanger according to the invention.

The heat exchanger shown in the drawings includes a first set of pockets 1 and a second set of pockets 2, which are stacked alternately with each other in a stacking direction going from left to right in FIG. 1, over a depth H measured in the longitudinal direction downwardly between two levels 15 in FIG. 1. Over this depth, the pockets are of a substantially constant transverse width e (see FIG. 3), and are bounded longitudinally by substantially flat, vertical surfaces. The surface of a pocket 1 facing towards the right in FIG. 1 is in direct contact with the surface of the next pocket 2 facing towards the left. The surface of a pocket 2 facing towards the right in FIG. 1 is separated from the surface of the next pocket 1 facing towards the left by a gap 3.

Each gap 3 is equipped with a thin, heat conducting, corrugated plate 4, the crests of which are in contact alternately with the two faces of the pockets which define the gap. Air is able to flow in the known way in the gaps 3, within horizontal ducts (FIG. 1) which are defined between the corrugations of the plates 4, for heat transfer, through these plates and the walls of the pockets, between the air and fluids that flow within the latter, as will be explained later herein.

Figure 3:
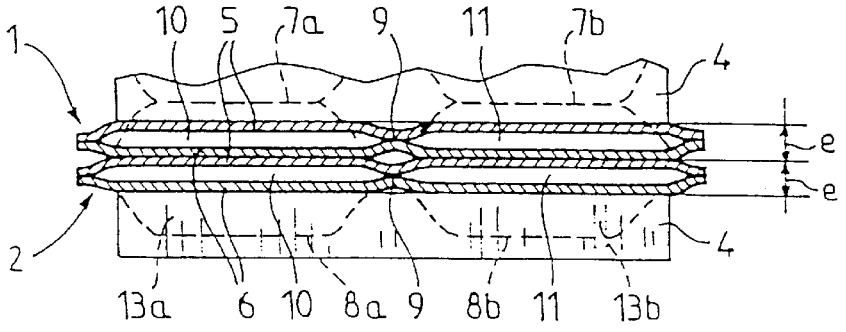
FIG. 3 is a scrap view, seen in cross section taken on the line III—III in FIG. 2.
Figure 2:
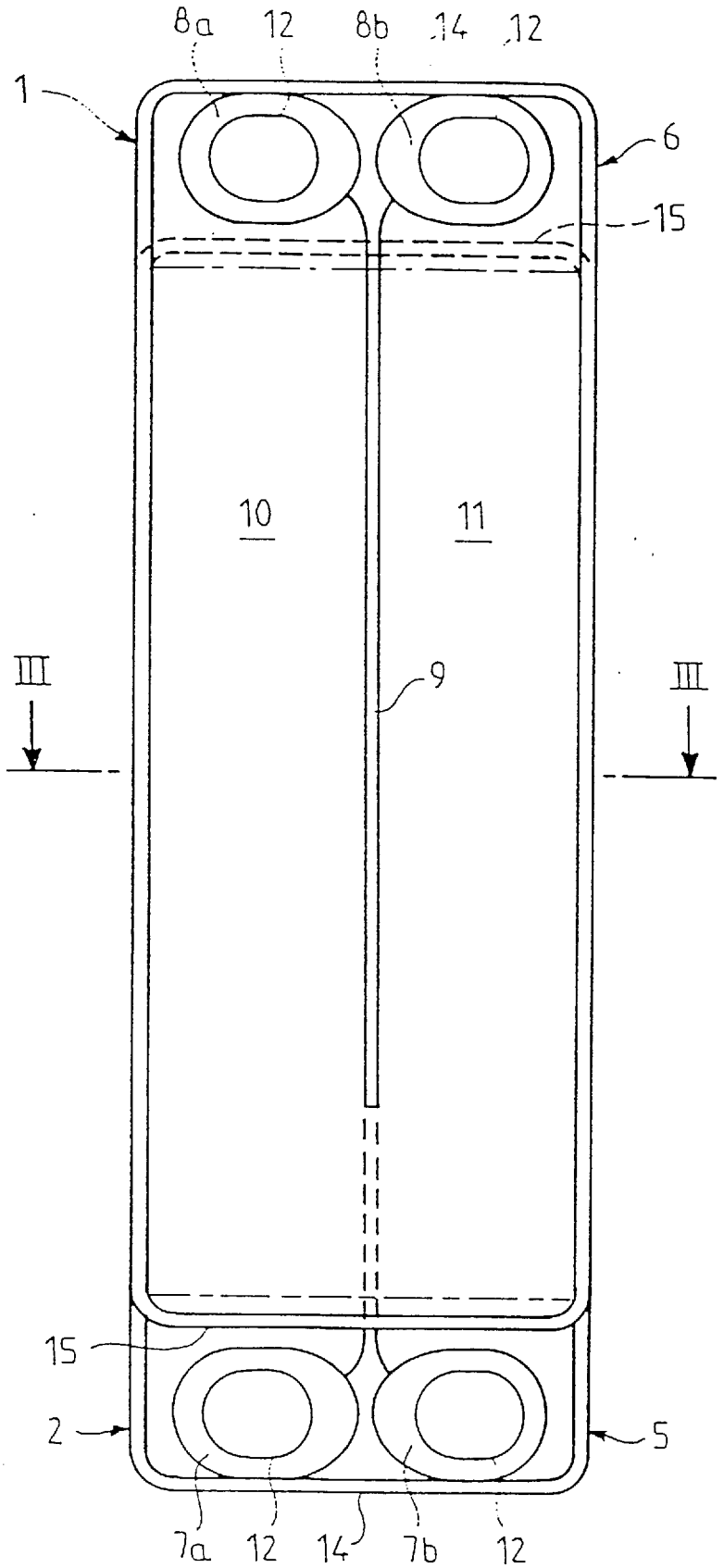
FIG. 2 is a view in cross section taken on the line 11—11 in FIG. 1.

All of the pockets 1 and 2 are identical to each other, each pocket being defined by two metal plates 5 and 6 (also referred to as pocket plates), which are also identical to each other. These plates are press formed to give a dished cross section, and are joined together and sealed over the whole of their substantially rectangular contour so as to define a closed internal space (FIG. 3). The lower edges of the pockets 1 lie at the lower limit 15 of the depth H, and the same pockets project upwardly beyond the upper limit 15 of the depth H. In the region lying above the upper limit 15 of the depth H, the depth of the recesses defined by the dished profile of the plates 5 and 6 is greater than the small, constant depth of these recesses over the depth H, by an amount such that the flat base portion 7 of the dished profile of the plate 5, which is convex towards the left, of a pocket 1 is abutted on the flat base portion 8 of the plate 6, convex towards the right, of the pocket 1 that lies immediately to its left.

The transverse width of each pocket is thus equal, in this region, to the pitch of the alternating stack over the depth H, and to the pitch of the gaps 3 and the two sets of pockets. In the same way, the upper edge 14 of the pockets 2 lies at the upper limit 15 of the depth H, and these pockets extend downwards beyond the lower limit 15 of the depth H, being broadened, i.e. enlarged in transverse width, and making mutual contact through flat base portions 7 and 8 which face towards the left and right respectively.

The plates 5 and 6 of each pocket 1, 2 respectively are also sealingly joined together in a median junction zone 9, i.e. a zone halfway across the width of the pockets. The zone 9 is continuous from the terminal edge 14 of the pockets concerned which lies above or below the limits 15 of the depth H, to the level 15 closest to the opposite terminal edge 14 of the pockets but spaced away from that opposite edge 14. The internal space in each pocket therefore has a U-shaped configuration, in which the ends of the two branches 10 and 11 of the pocket lie in the broadened region of the pocket, with each of the flat base portions 7 and 8 being divided by the junction zone 9 into two portions 7*a* and 7*b*, 8*a* and 8*b* respectively.

A hole 12 is formed through each of the plate portions 7*a*, 7*b*, 8*a* and 8*b*. The holes 12 in two adjacent base portions provide communication between the broadened ends of the branches of the U-shaped flow paths of two juxtaposed pockets of the same set. The broadened ends 13*a* of the branches 10 serve as fluid inlet chambers for each pocket, and are joined together through the corresponding holes 12 so as to constitute an inlet duct. Similarly, the broadened ends 13*b* of the branches 11 serve as fluid outlet chambers for each pocket, and are joined together through the corresponding holes 12 so as to constitute an outlet duct.

The fluid flows in parallel along the U-shaped flow paths of the various pockets of the same set, from the inlet duct to the outlet duct. The mutually adjacent base portions 7*a* or 7*b*, and the base portions 8*a* or 8*b* of two juxtaposed pockets, are of course joined sealingly together around the through holes 12. One of the two holes located at the ends of each inlet or outlet duct is connected to a suitable tubular inlet or outlet branch (not shown) of the heat exchanger, the other one of these two holes being sealingly closed, for example by a blanking plate.

What is claimed is:

1. A triple heat exchanger defining a first and second fluid circuit separate from each other, for heat transfer between a gaseous first fluid, and second and third fluids flowing in the first and second fluid circuits, the heat exchanger comprising a plurality of thermally conductive pocket plates stacked so as to define a stacking direction, the pocket plates defining between them a first set of generally flat pockets constituting part of the first fluid circuit, a second set of generally flat pockets constituting part of the second fluid circuit, a plurality of generally flat gaps, with a pocket of each said set being disposed between two consecutive said flat gaps, each pocket being separated by a said pocket plate from at least one said gap, so that heat transfer can take place through that plate between said gaseous first fluid flowing in the gap and fluid in the pocket, wherein the plates defining within them the two pockets disposed between two consecutive said gaps are superimposed in the stacking direction and are in direct thermal contact with each other, with the pockets extending over substantially the whole surface area of the stack, and wherein said pocket plates are press formed with flat dished portions defining concavities, the pocket plates defining each said pocket being stacked together with concavities facing towards each other, and being joined sealingly together at their periphery. wherein said pocket plates defining each said pocket define a first end thereof and a median junction zone bisecting the lateral width of the plates between their side edges, said pocket plates are joined sealingly together in the junction zone over at least a substantial portion of their length extending from said first end of the plates, wherein to define within a corresponding pocket a fluid flow path having branches disposed on either side of the junction, wherein each pocket plate has an end portion adjacent to said first end, the dished portion of the plate on either side of the junction zone being deeper in said end portion than in the remainder of the plate, to define a fluid inlet chamber and a fluid outlet chamber of the corresponding pocket, each said dished portion having a base portion, said base portion of each pocket plate being in direct sealing contact in said end portion of the plate with the corresponding base portion of an adjacent pocket plate defining a pocket of the same set of pockets, each said base portion having a through hole in the end portion of the plate, said holes of said adjacent pocket plates being juxtaposed, each pair of said juxtaposed holes being sealed from the outside.

2. A heat exchanger according to claim 1, wherein the inlet and outlet of said first set of pockets are aligned at opposite ends of the stack with those of said second set.

3. A heat exchanger according to claim 2, wherein the pockets of at least one said set of pockets are interrupted, at that end of the stack at which the inlet and outlet chambers of those pockets are disposed and remote from the inlet and outlet chambers of the other set of pockets, whereby to define at least one end zone of the stack in which zone the said first fluid exchanges heat with only one of the said second and third fluids.

4. A heat exchanger according to claim 1, wherein, in each said set of pockets, the inlet chambers of the pockets are aligned with the outlet chambers thereof so as to define an inlet duct comprising the said inlet chambers, and an outlet duct comprising the said outlet chambers, the said U-shaped fluid flow paths defined by the said pockets being disposed in parallel between the said inlet and outlet ducts.

* * * * *